US008481891B2

(12) United States Patent
Janakiraman et al.

(10) Patent No.: US 8,481,891 B2
(45) Date of Patent: Jul. 9, 2013

(54) INDUCTION IRONING SYSTEM

(75) Inventors: Chandra Mohan Janakiraman, Evanston, IL (US); Job Jan Van Der Burg, Drachten (NL); Yong Jiang, Hoogeveen (NL); Ronald Albert Plantinga, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 754 days.

(21) Appl. No.: 12/442,752

(22) PCT Filed: Sep. 28, 2007

(86) PCT No.: PCT/IB2007/053956

§ 371 (c)(1),
(2), (4) Date: Oct. 28, 2009

(87) PCT Pub. No.: WO2008/038253

PCT Pub. Date: Apr. 3, 2008

(65) Prior Publication Data

US 2010/0043259 A1 Feb. 25, 2010

(30) Foreign Application Priority Data

Sep. 29, 2006 (EP) ..... 06121521

(51) Int. Cl.
*D06F 75/26* (2006.01)

(52) U.S. Cl.
USPC ..... 219/245; 219/250; 219/667; 38/82

(58) Field of Classification Search
USPC ..... 219/245, 246, 250, 254, 259, 646, 219/667; 38/97
See application file for complete search history.

(56) References Cited

U.S. PATENT DOCUMENTS

| | | | | |
|---|---|---|---|---|
| 1,483,427 | A | 2/1924 | Gaynor et al. | |
| 2,415,688 | A * | 2/1947 | Hall, Jr. | 219/246 |
| 7,681,342 | B2 * | 3/2010 | Choi | 38/77.5 |

FOREIGN PATENT DOCUMENTS

| | | | |
|---|---|---|---|
| DE | 3538544 | A1 | 5/1987 |
| GB | 588609 | | 5/1947 |
| GB | 2201319 | A | 8/1988 |
| GB | 2392171 | A | 2/2004 |
| JP | 60060516 | A | 4/1985 |
| JP | 05245300 | A * | 9/1993 |
| JP | 05283154 | A | 10/1993 |
| JP | 05329053 | A | 12/1993 |
| JP | 07197135 | A | 8/1995 |
| JP | 10000299A | A | 1/1998 |
| JP | 2005158658 | A | 6/2005 |

* cited by examiner

*Primary Examiner* — Stephen W Smoot

(57) ABSTRACT

An ironing system (500) comprises an iron (510) with a soleplate (512) comprising an induction heatable material. The ironing system (500) further comprises a unit (520, 530) that includes at least one induction coil (540) and a device (550). The induction coil (540) charges the iron (510) whereas the device (550) detects the temperature of the soleplate (512) by sensing a change in current flowing through the induction coil (540) or by sensing a change in voltage across the induction coil (540). The current or voltage changes as self inductance of the induction coil (540) changes with magnetic permeability of the soleplate (512) as a function of its temperature. The device (550) switches the induction coil (540) on or off depending on the detected temperature.

11 Claims, 7 Drawing Sheets

INDUCTION IRONING SYSTEM

The invention relates to an ironing system, more particularly to an induction ironing system.

BACKGROUND OF THE INVENTION

Induction ironing systems consist of irons whose soleplates are heated by electromagnetic radiation from an induction coil. This heating method requires the soleplate to be in close proximity to the induction coil. The ironing systems usually include a temperature regulating sub-system that switches on/off the heating means (induction coil) when the soleplate attains a pre-set temperature, based on the input from a temperature sensor (e.g. a thermistor or a thermostat). However, placement of the sensor is often difficult and has an impact on the mechanical construction of the induction ironing system. Furthermore, the response time of the sensor (due to air-gaps, moisture, etc.) results in an inaccurate and slow functioning of the temperature regulating sub-system thereby causing a wide soleplate temperature range that decreases ironing performance. In a case where the induction coil is located inside an ironing board, further problems arise. Due to the dynamics of the iron during ironing, it is difficult to locate the sensor at any position, as it is a probabilistic event that the iron would come right above the sensor and provide sufficient time to detect the temperature of the soleplate. Besides, when a garment to be ironed is placed between the ironing board and the iron, the garment would interfere with the function of the sensor.

UK Patent Application GB2392171 describes an induction ironing system comprising an iron and an ironing board with multiple induction coils. In order to trigger the electromagnetic field, the ferrous base of the iron has to be in contact with the electromagnetic field produced by the electromagnetic coils. To stop the heating process of the iron, either the current passing through the ironing board has to be switched off or the iron has to be lifted upwards until it goes out of range of the electromagnetic field. However, this system does not ensure controlled temperature and hence may result in the scorching of fabric.

SUMMARY OF THE INVENTION

In accordance with a first aspect of the invention, an ironing system comprises an iron including a soleplate, wherein said soleplate comprises an induction heatable material; and a unit including at least one induction coil and a device, wherein said induction coil is configured for charging said iron and said device is configured for detecting a temperature of said soleplate by sensing a change in current flowing through said induction coil or by sensing a change in voltage across said induction coil, said change in current or voltage being caused by a change in self inductance of said induction coil, said change in self inductance further being caused by a change in magnetic permeability of said soleplate as a function of its temperature, said device further being configured for switching said induction coil on or off depending on the temperature. The iron receives the necessary energy for ironing from the induction coil that is placed in the unit. An alternating magnetic field generated by the induction coil induces eddy currents in the soleplate and thus the soleplate gets heated up. The iron is then said to be charged. The induction heatable materials change their magnetic permeability with temperature. The self inductance of the induction coil and hence the current passing through the induction coil vary as a function of the magnetic permeability This is used as a trigger to switch the induction coil on or off based on the pre-determined relationship between the desired soleplate temperature and the current passing through the induction coil. In this manner, the temperature of the soleplate can be determined without the need of a temperature sensor.

According to another embodiment of the invention, said device comprises a current/voltage sensing circuit connected to said induction coil, wherein said current/voltage sensing circuit senses a change in current through said induction coil or senses a change in voltage across said induction coil. The device further comprises a current switching circuit, wherein said current switching circuit switches said induction coil on or off. The device furthermore comprises a temperature control circuit, wherein said temperature control circuit controls said current switching circuit depending on the current/voltage sensed by said current/voltage sensing circuit. The device is thus capable of switching said induction coil on or off based on the current/voltage in the coil that it can sense (this current/voltage having a relationship to the soleplate temperature as pre-established and programmed in the system.). Therefore, the temperature of the soleplate can be regulated without the help of a conventional temperature sensor According to an embodiment of the invention, the induction heatable material is a ferro-magnetic material having its Curie temperature substantially close to the ironing temperature. Phytherm alloys are examples of such commercially available materials/alloys. Phytherm 230 or Phytherm 260 may be used as induction heatable materials. The Curie temperature of the induction heatable material of the soleplate is in the range of 100 to 300° C. This soleplate with above mentioned Curie temperature is suitable for ironing at temperatures in the range of 100 to 250° C. However, in order to ensure safe ironing of delicate garments such as silk, in another embodiment, a shoe could be detachably connectable to the soleplate to enable ironing-delicate garments at temperatures in the range of 50° C.-150° C.

DETAILED DESCRIPTION OF THE INVENTION

Figure 1:
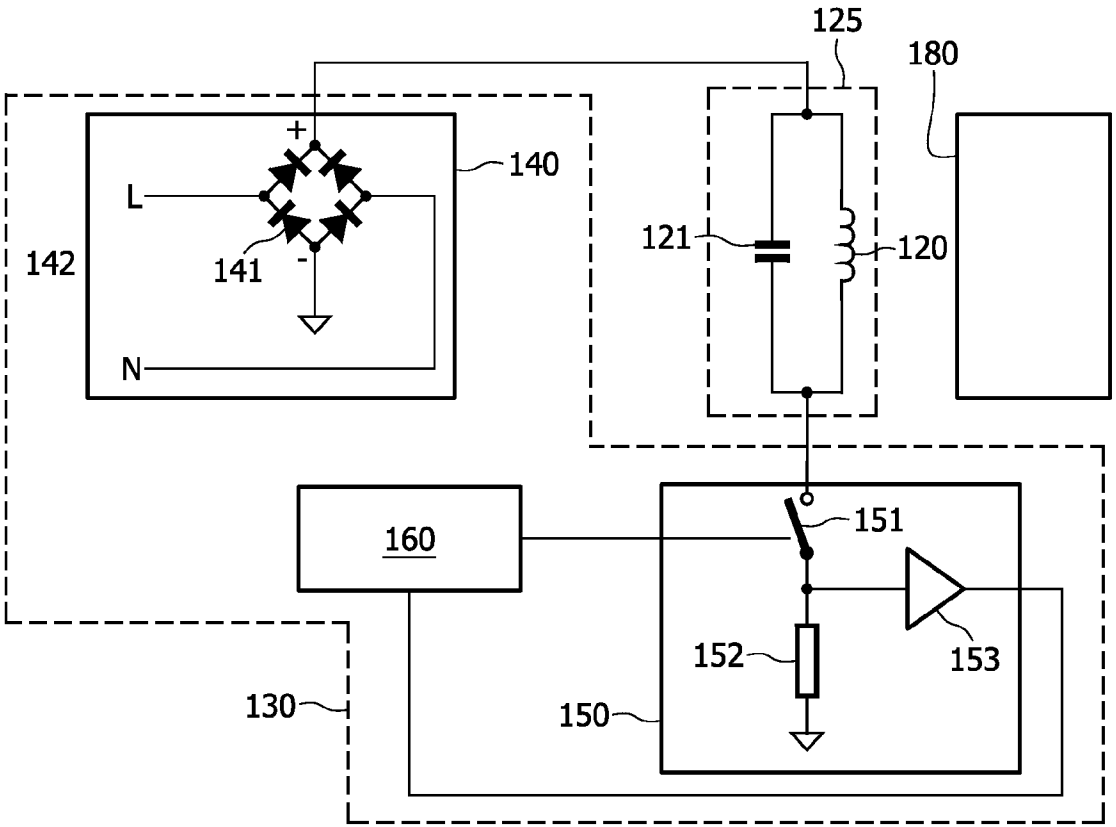
FIG. 1 is a schematic representation of a device of an ironing system according to an embodiment of the invention.

The present invention will be described with respect to particular embodiments and with reference to certain drawing figures, but the invention is not limited thereto but only by the claims. Any reference signs in the claims shall not be construed as limiting the scope of the invention. The drawings described are only schematic and are non-limiting. In the drawings, the size of some of the elements may be exaggerated and not drawn to scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

FIG. 1 is an example schematically showing a first embodiment of the invention. As shown in FIG. 1, a device 130 is connected to an induction coil 120. Further as shown in FIG. 1, the device 130 includes a current/voltage sensing circuit 150, a current switching circuit 140 and a temperature control circuit 160. The current/voltage sensing circuit 150 includes a switch 151, a resistor 152 and a signal-conditioning device 153. The current switching circuit 140 includes a bridge rectifier 141 and is connected to the supply voltage 142. The induction coil 120 and a capacitor 121 together form a parallel resonant circuit 125. A sole plate 180 is heated by electromagnetic radiation from the induction coil 120.

While charging the iron either during ironing or during rest, the alternating magnetic field generated by the induction coil 120 induces eddy currents in the soleplate 180. The magnetic properties of induction heatable material of the soleplate 180 are dependent on the temperature at which they are used. These properties progressively decrease and finally disappear beyond a characteristic temperature. This temperature is generally referred to as "Curie temperature" of the material.

The current/voltage sensing circuit 150 enables the temperature control circuit 160 to activate the current switching circuit 140 when the temperature of the soleplate 180 is below the Curie temperature. The self-inductance of the induction coil 120 changes when the temperature of the soleplate 180 exceeds the Curie temperature. This is because the magnetic permeability of the material of the soleplate 180 drops down to a low value approaching unity when the temperature is beyond the Curie temperature. This will be measured by the current/voltage sensing circuit 150 and the temperature control circuit 160 will be disabled. The current switching circuit 140 becomes inactive and the induction coil 120 gets switched off. The soleplate 180 cools down. The magnetism of the soleplate 180 is revived when the temperature of the soleplate 180 drops below the Curie temperature.

The current through the induction coil 120 can be calculated using the equation:

$$i = \frac{1}{L} \cdot \int u \cdot dt \tag{1}$$

wherein i is the current through the induction coil 120, L is the self-inductance of the induction coil 120, u is the induced voltage and t is time. The self-inductance L is a function of magnetic permeability μ which in turn is a function of temperature T. For ferromagnetic materials, μ changes rapidly with temperature, when temperature T exceeds the Curie temperature. Hence the self-inductance L varies as magnetic permeability μ of the soleplate 180 varies as a function of its temperature T. According to equation 1, the current i through the induction coil 120 varies with changes in self-inductance L of the induction coil 120.

Figure 2:
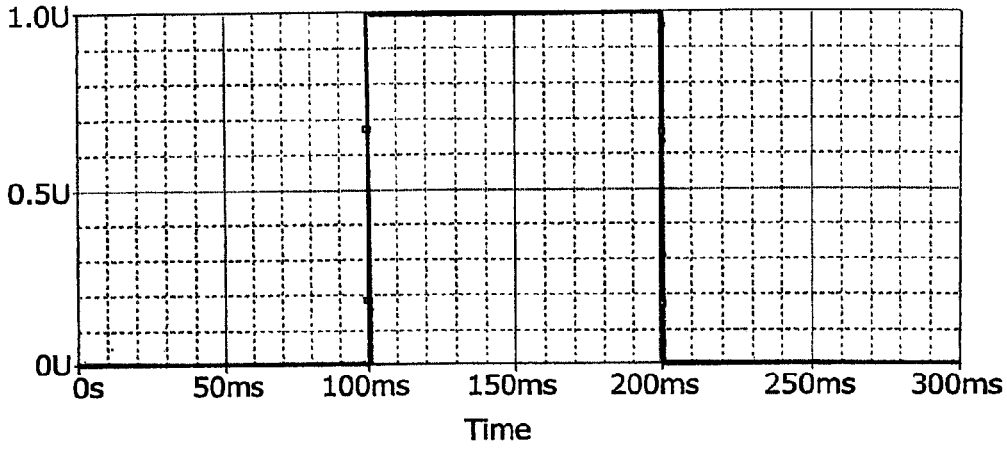
FIG. 2 is a representation of the output of a temperature control circuit.
Figure 3:
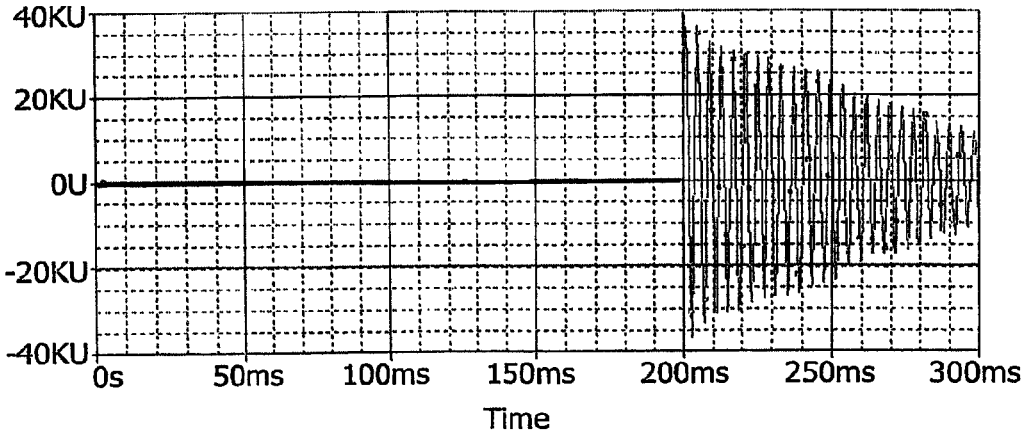
FIG. 3 shows a response across an induction coil when a switch is opened for a high value of inductance.
Figure 4:
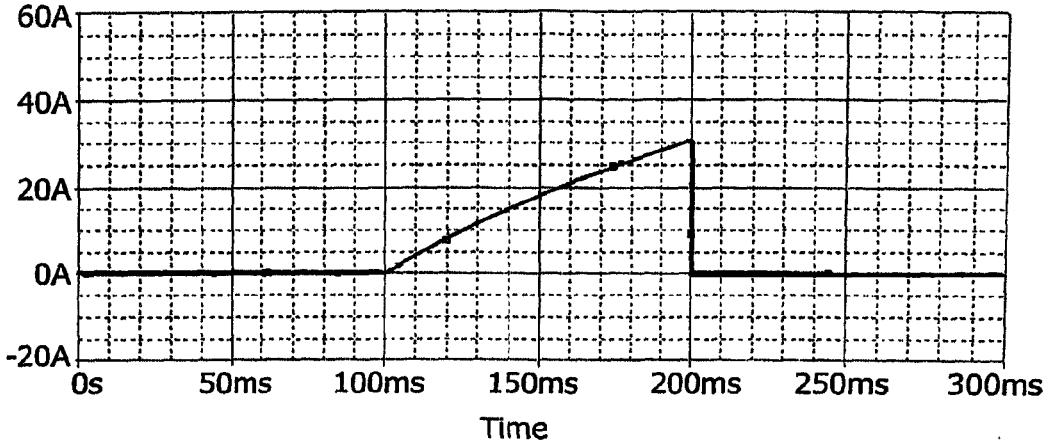
FIG. 4 shows a current through a current/voltage sensing circuit for a high value of inductance.
Figure 5:
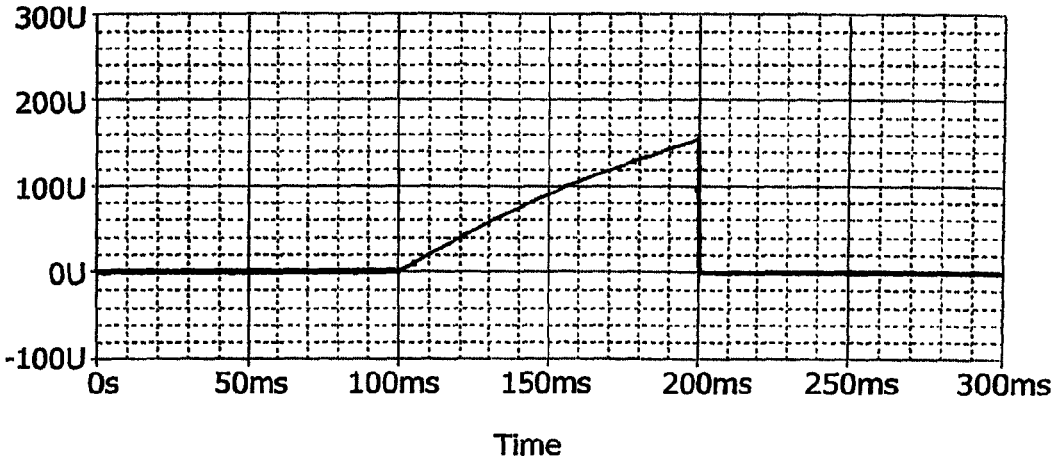
FIG. 5 shows a voltage across a current/voltage sensing circuit for a high value of inductance.
Figure 6:
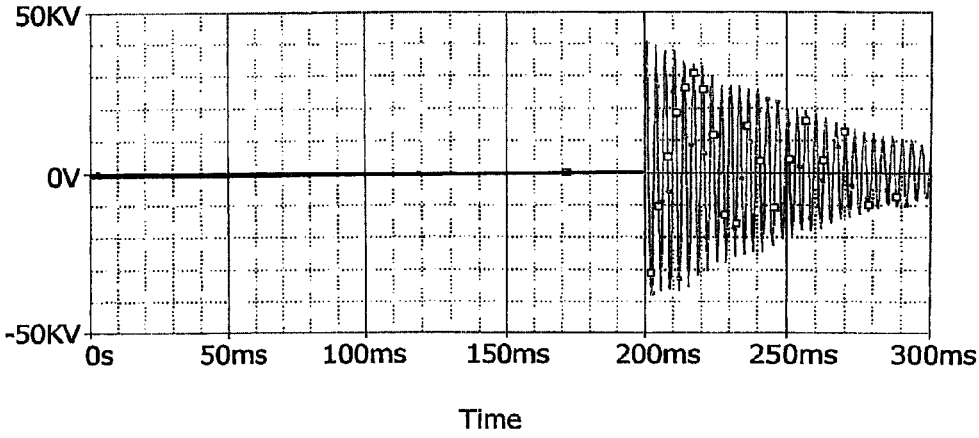
FIG. 6 shows a response across an induction coil when a switch is opened for a low value of inductance.
Figure 7:
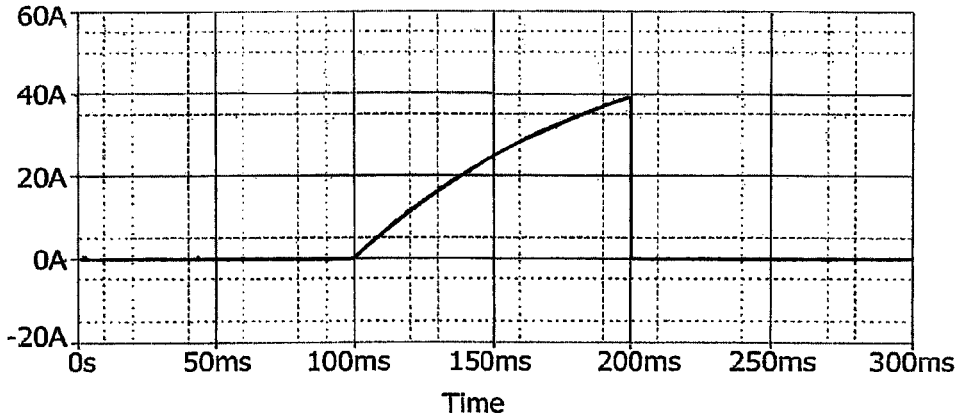
FIG. 7 shows a current through a current/voltage sensing circuit for a low value of inductance.
Figure 8:
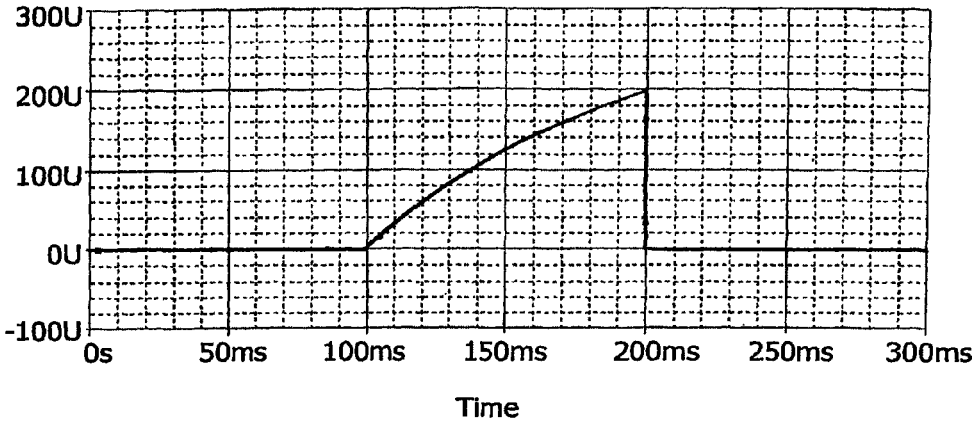
FIG. 8 shows a voltage across a current/voltage sensing circuit for a low value of inductance.

The current i through the induction coil 120 is measured by the resistor 152. The parallel resonant circuit 125, formed by the induction coil 120 and the capacitor 121, is connected to the supply voltage 142 via the switch 151. When the switch 151 is closed, linearly increasing current flows through the parallel resonant circuit 125, the switch 151 and the resistor 152. This current i is transferred into a voltage u across the resistor 152 and is fed back via the signal conditioning device 153 to the temperature control circuit 160. The signal conditioning device 153 provides signal conditioning (e.g. low pass filtering and amplification) to the voltage u across the resistor 152. The temperature control circuit 160 provides the switch 151 with a square wave signal. The duty cycle of this control signal varies to enable power adjustment. It can be a fixed duty cycle (e.g. 50%) if no power control is necessary. Then it is simply a power on/off control. The switch 151 is controlled via a square wave as shown in FIG. 2. It is a representation of the output of the temperature control circuit 160, used to control the switch 151. At a high signal level the switch 151 is closed. As soon as the switch 151 is closed, current i flows through the induction coil 120, the capacitor parallel to the coil 121, the switch 151 and through the resistor 152. During this phase, energy is stored in the induction coil 120. When the switch 151 is opened, the energy is released resulting in a (induction) voltage response across the coil 120. The frequency of this response is determined by the self-inductance L of the coil 120 and the capacitance of the capacitor 121. The voltage response across the induction coil 120 for a high value of self-inductance L of the induction coil 120 is shown in FIG. 3 when the switch 151 is opened. The response across the induction coil 120 for a low value of self-inductance L is shown in FIG. 6. FIGS. 4 and 5 show the current i through and voltage u across the resistor 152 for a high value of self-inductance L of the induction coil 120, whereas FIGS. 7 and 8 show the current i through and voltage u across the resistor 152 for a low value of self-inductance L of the induction coil 120.

As the switch 151 is closed, current i flows through the resistor 152, resulting in a voltage u across this resistor 152. The amplitude of this voltage u is used to switch the temperature control circuit 160 on or off. The amplitude of the current i determines the trigger point for temperature control circuit 160. It is clear that the self-inductance L of the induction coil 120 is mainly determined by μ of the soleplate to be heated. When the soleplate is heated up to the Curie temperature, μ of the soleplate drops significantly, resulting in a lower self-inductance L. As the self-inductance L of the induction coil 120 decreases, the current i through the switch 151 and the resistor 152 increases. It further results in a higher voltage u across the resistor 152 and a higher response voltage across the induction coil 120 when the switch 151 is released. Both can be used to trigger the temperature control circuit 160.

Commercial alloys like Phytherm 230 or Phytherm 260 can be used whose Curie temperature can be customized. Phytherm 230 has a composition with 50 wt % Ni, 10 wt % Cr and rest Fe. The Curie temperature is 230° C. Phytherm 260 has a composition with 50 wt % Ni, 9 wt % Cr and rest Fe. The Curie temperature is 260° C.

Figure 9:
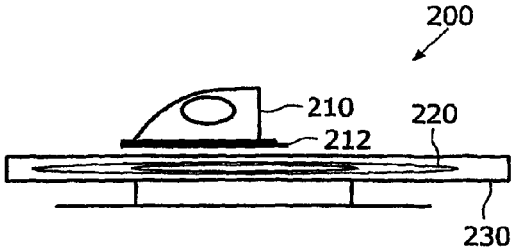
FIG. 9 shows an ironing system according to an embodiment of the invention comprising an iron, an ironing board with one or more induction coils.

FIG. 9 shows an embodiment of an ironing system 200. The ironing system 200 shown in FIG. 9 includes an iron 210 and an ironing board 230. The iron 210 is provided with a soleplate 212 comprising an induction heatable material. The ironing board 230 can be either a compact board or a full-size board. The one or more induction coils 220 positioned within the entire ironing board can charge the iron 210 continuously while ironing.

Figure 10:
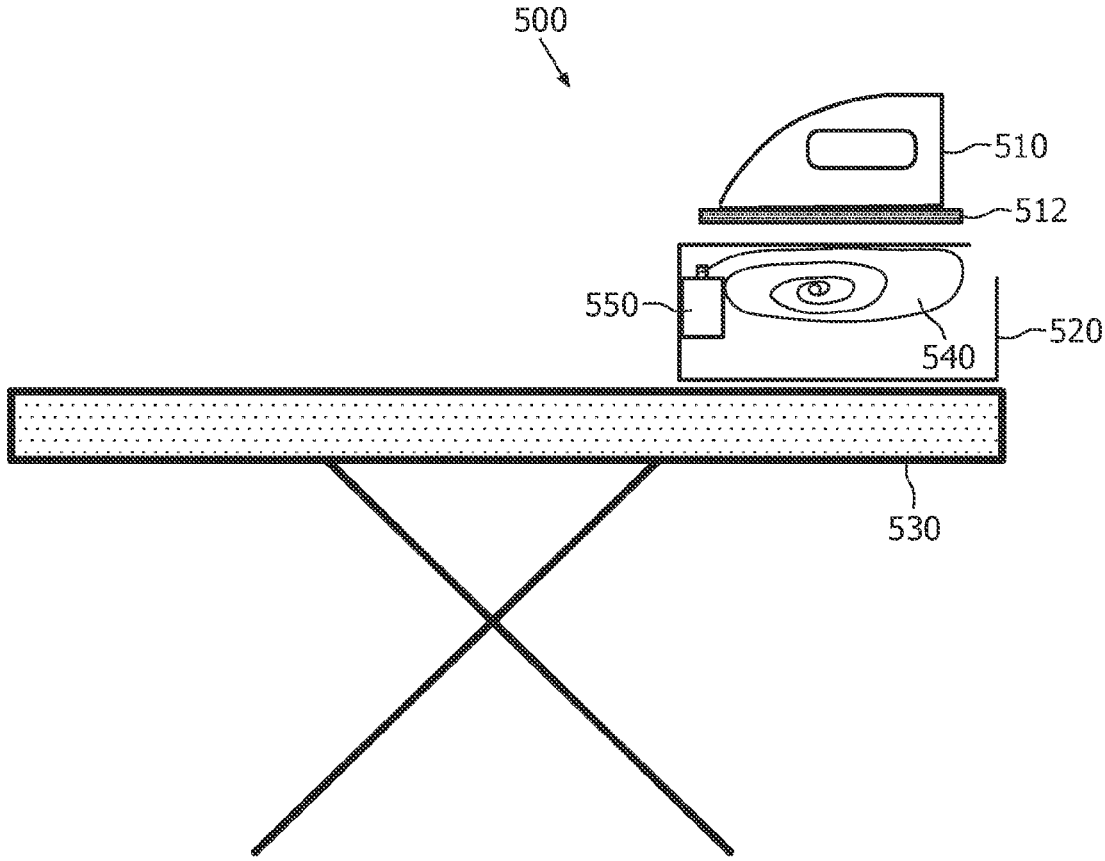
FIG. 10 shows an ironing system according to an embodiment of the invention comprising an iron, an ironing board and a charging base with one or more induction coils.

FIG. 10 shows an ironing system 500 comprising an iron 510, an ironing board 530 and a charging base 520 with one or more induction coils 540. The iron has a soleplate 512 made from a material whose Curie temperature is substantially close to the ironing temperature i.e. in the range of 100-300° C. The iron 510 has to be returned to the charging base 520 for charging. The alternating magnetic field generated by the induction coil 540 induces eddy currents in the soleplate 512 which then gets heated up. As the temperature of the soleplate exceeds the Curie temperature, the device 550 switches the induction coil 540 off and the iron 510 is ready for use.

Figure 11:
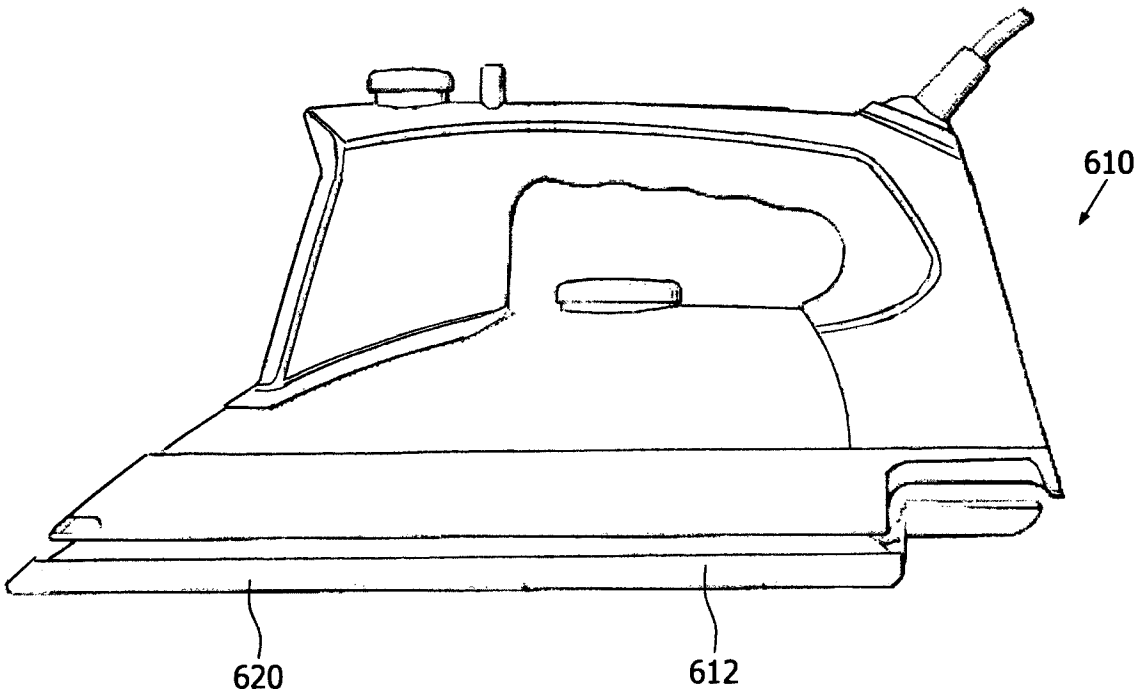
FIG. 11 shows an iron with an ironing shoe according to an embodiment of the invention.

FIG. 11 shows an iron 610 having an ironing shoe 620. The soleplate 612 is equipped with a perforation into which the ironing shoe 620 is inserted. All above mentioned embodiments are suitable for single temperature ironing i.e., if a particular material is chosen for the soleplate of the iron, its Curie temperature is fixed and the temperature range at which the iron can be used is fixed. If the temperature chosen is high, then the delicate garments such as silk cannot be ironed. The ironing shoe 620 enables low temperature ironing for delicate garments.

The invention claimed is:

1. An ironing system comprising:

an iron including a soleplate comprising an induction-heatable material;

a unit including at least one induction coil and a device, said induction coil being configured for charging said iron and said device configured for detecting an ironing temperature of said soleplate by sensing at least one of a change in current flowing through said induction coil and a change in voltage across said induction coil, said change in current or voltage being caused by a change in self inductance of said induction coil, said change in self inductance further being caused by a change in magnetic permeability of said soleplate as a function of said ironing temperature, said device further being configured for switching said induction coil on or off depending on the ironing temperature.

2. The system of claim 1 where said device comprises:

a current/voltage sensing circuit connected to said induction coil for sensing at least one of a change in current through said induction coil and a change in voltage across said induction coil;

a current switching circuit for switching said induction coil on or off; and a temperature control circuit for controlling said current switching circuit depending on the current/voltage sensed by said current/voltage sensing circuit.

3. The system of claim 1 where said induction-heatable material comprises a ferro-magnetic material having a Curie temperature substantially close to the ironing temperature of the soleplate.

4. The system of claim 3 where said ferromagnetic material has a composition consisting approximately of:

50% by weight of Ni, 10% by weight of Cr, and 40% by weight of Fe; or

50% by weight of Ni, 9% by weight of Cr, and 41% by weight of Fe.

5. The system of claim 3 where said Curie temperature of said induction-heatable material is in a range of 100 to 300° C.

6. The system of claim 5 where said soleplate with said Curie temperature is suitable for ironing at temperatures in the range of 100 to 250° C.

7. The system of claim 1 where said soleplate includes a detachable shoe.

8. The system of claim 1 where the at least one induction coil is disposed in at least one of an ironing board and a charging base.

9. A unit for controllably heating an iron including a soleplate comprising an induction-heatable material, said unit including at least one induction coil and a device, said induction coil being configured for charging said iron and said device being configured for detecting an ironing temperature of said soleplate by sensing at least one of a change in current flowing through said induction coil and a change in voltage across said induction coil, said change in current or voltage being caused by a change in self inductance of said induction coil, said change in self inductance further being caused by a change in magnetic permeability of said soleplate as a function of said ironing temperature, said device being further configured for switching said induction coil on or off depending on the ironing temperature.

10. The unit according to claim 9 where said device comprises:

a current/voltage sensing circuit connected to said induction coil for sensing at least one of a change in current through said induction coil and a change in voltage across said induction coil;

a current switching circuit for switching said induction coil on or off; and a temperature control circuit for controlling said current switching circuit depending on the current/voltage sensed by said current/voltage sensing circuit.

11. An iron including a soleplate comprising an induction-heatable material for use with a unit including at least one induction coil and a device, said induction coil being configured for charging said iron and said device being configured for detecting an ironing temperature of said soleplate by sensing at least one of a change in current flowing through said induction coil and a change in voltage across said induction coil, said change in current or voltage being caused by a change in self inductance of said induction coil, said change in self inductance further being caused by a change in magnetic permeability of said soleplate as a function of said ironing temperature, said device further being configured for switching said induction coil on or off depending on the ironing temperature;

where said induction-heatable material of said iron soleplate comprises a ferromagnetic material having a Curie temperature substantially close to the ironing temperature.

* * * * *